US008776561B1

(12) United States Patent
Jones

(10) Patent No.: US 8,776,561 B1
(45) Date of Patent: Jul. 15, 2014

(54) DOOR KNOB UNLOCKING TOOL KIT

(76) Inventor: James M. Jones, Marengo, IN (US)

( * ) Notice: Subject to any disclaimer, the term of this patent is extended or adjusted under 35 U.S.C. 154(b) by 0 days.

(21) Appl. No.: 13/373,360

(22) Filed: Nov. 10, 2011

Related U.S. Application Data

(60) Provisional application No. 61/456,654, filed on Nov. 10, 2010.

(51) Int. Cl.
*E05B 19/20* (2006.01)

(52) U.S. Cl.
USPC ..... 70/394; 70/401; 70/493

(58) Field of Classification Search
USPC ..... 70/393, 394, 401, 402, 405, 406, 409, 70/494, 367, 368, 493
See application file for complete search history.

(56) References Cited

U.S. PATENT DOCUMENTS

| | | | | |
|---|---|---|---|---|
| 1,977,362 | A | 10/1934 | Wakstein | |
| 2,279,592 | A | 4/1942 | Machinist | |
| 2,309,677 | A | 2/1943 | Segal | |
| 3,264,908 | A | 8/1966 | Moore | |
| 3,452,562 | A | 7/1969 | Loveless | |
| 4,006,613 | A | 2/1977 | Zion | |
| 4,094,176 | A | 6/1978 | Hughes | |
| 4,339,863 | A | 7/1982 | Block | |
| 4,457,193 | A | 7/1984 | Matthey | |
| 4,778,302 | A | 10/1988 | Martinez | |
| 6,082,159 | A | 7/2000 | Larsen | |
| 6,134,928 | A * | 10/2000 | Kang | 70/394 |
| 6,148,652 | A | 11/2000 | Magini et al. | |
| 6,151,936 | A | 11/2000 | Randall | |
| 6,173,595 | B1 | 1/2001 | Hughes | |
| 6,931,898 | B2 * | 8/2005 | Wendt | 70/394 |
| 8,001,816 | B2 * | 8/2011 | Black | 70/394 |
| 2003/0101782 | A1 | 6/2003 | Wendt | |
| 2009/0266124 | A1 * | 10/2009 | Dos Santos | 70/394 |
| 2010/0037733 | A1 | 2/2010 | Robins | |
| 2010/0116008 | A1 * | 5/2010 | Black | 70/394 |

* cited by examiner

*Primary Examiner* — Christopher Boswell
(74) *Attorney, Agent, or Firm* — Carrithers Law Office PLLC

(57) ABSTRACT

A tool kit for unlocking a door knob lock set which bypasses the cylinder and pin pairs which normally must be aligned properly with the proper key. The tool kit includes a pin lifting tool which is used to move the pins so that a forked tool is inserted into the key way, through the cylinder, through an aperture in the end of the cylinder and on to the shaft which must be turned to unlock the lock. The forked tool straddles the shaft and then the forked tool is turned, thereby turning the shaft and unlocking the lock.

19 Claims, 5 Drawing Sheets

DOOR KNOB UNLOCKING TOOL KIT

CROSS REFERENCE TO RELATED APPLICATIONS

This application claims priority from Provisional Application Ser. No. 61/456,654 filed on Nov. 10, 2010 which is incorporated by reference herein.

TECHNICAL FIELD

The present invention relates to the field of tools used to unlock doors in the event that the proper key is not available.

BACKGROUND OF THE INVENTION

When a homeowner loses the key which unlocks a door, a locksmith is called. The locksmith will use whatever means necessary to open the door and either rekey the lock or make a key to fit the present lock set. A locksmith will sometimes use a tool set to pick the lock. Picking a lock, even with the right tools, is cumbersome, time consuming, and not always possible. If the lock can't be picked, a locksmith will use a drill to destroy the locking mechanism and thereby open the knob.

A large number of lock sets differ from others in the design of the lock mechanism. It is this difference that makes the present invention particularly useful because unlocking a knob with the present invention is done quickly and with relative ease when compared to picking the lock or destroying the lock with a drill and other tools. In simple terms, the present invention provides a tool which can be inserted through the key way and on through a hole in the lock cylinder and then to the shaft that must be turned to unlock the knob. This tool actually bypasses the pins which must be aligned properly by the correct key. Once the tool is in contact with the shaft, the tool is used to turn the shaft and unlock the door.

The hole mentioned above does not exist in some door knob lock sets and therefore, the present invention will not unlock those door knobs. However, many existing doorknobs do contain this hole, making the tools of the present invention very useful and valuable.

DESCRIPTION OF THE RELATED ART

U.S. Pat. No. 4,339,863 by Block for LOCK OPENING TOOL issued on Jul. 20, 1982 teaches a tool for opening a lock which has been prepared by drilling out the lock cylinder. While this approach will be successful in unlocking the lock, the lock has now been destroyed. The present invention accomplishes the same task more economically and faster and without requiring the lock to be rebuilt or replaced.

U.S. Pat. No. 6,082,159 by Larsen for POCKET LOCK PICK issued on Jul. 4, 2000 teaches a combination including a pick tool and a tension tool used to pick a lock. This combination can be used by an expert to unlock a lock, and would still require several minutes even for an expert to unlock the lock. The present invention is simpler, faster and does not require and talents of an expert lock picker.

SUMMARY OF THE INVENTION

In accordance with the present invention, there is provided a door knob unlocking tool kit including a door knob lock with a cylinder rotatably disposed within a barrel, the cylinder. The barrel has a plurality of parallel transverse coaxial pairs of cylindrical voids formed therein and each pair of coaxial cylindrical voids has a spring urging a pair of pins of various lengths, one pin above the other, toward a center of the cylinder. The cylinder has a key way formed in a first end and the pin pairs prevent the turning of the cylinder within the barrel unless the pins are urged against the springs exactly to a point where the top ones of the pairs are totally contained within the cylindrical voids formed within the barrel and the lower ones of the pin pairs are totally contained within the cylindrical voids formed within the cylinder. A selected key may be inserted into the key way with the key aligning the pins so that the cylinder may be turned within the barrel. The cylinder has an aperture formed within a second end thereof. Also included in the kit is a pin lifting tool including a handle with a first longitudinal member extending from the end thereof. The first longitudinal member is capable of being inserted into the key way and lifting the pin pairs up into the cylindrical voids. Also in the kit is a forked tool including a handle with a second longitudinal member extending from the end thereof. The second longitudinal member has a fork formed on the free end thereof. The forked tool is capable of being passed through the key way, under and by the pins being lifted by the pin lifting tool, and through the aperture formed in the second end of the cylinder. The fork is placed astraddle of an end of a shaft which is turned to unlock the door knob lock. The forked tool is turned to turn and unlock the lock.

It is an object of this invention to provide a door unlocking tool kit which can be used to unlock a door knob lock easier and faster than can be done with known lock picking tools.

It is an object of this invention to provide a door unlocking tool which does not require the use of a power drill during the unlocking process.

It is an object of this invention to provide a door unlocking tool which does not destroy any part of the door knob or lock during the unlocking process.

It is an object of this invention to provide a door unlocking tool, the use of which can be learned and mastered in a much shorter time than the time required to learn and master the use of lock picking tools.

It is an object of this invention to provide a door unlocking tool which saves time and money for a homeowner needing the services of a locksmith to unlock a door.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
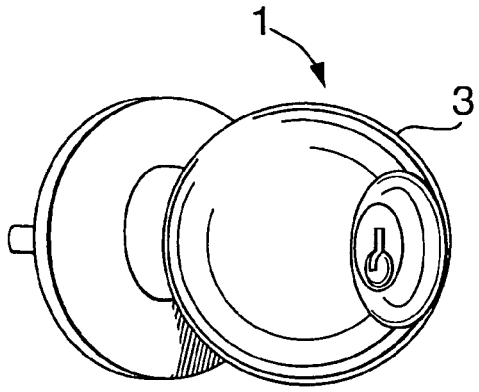
FIG. 1 is a perspective view of a typical door knob with a cylinder type key lock.
Figure 2:
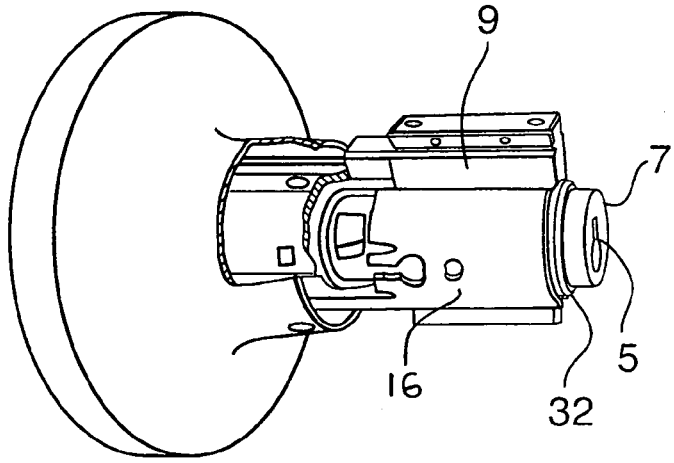
FIG. 2 is a perspective view of a door knob mechanism with the knob shell removed.
Figure 3:
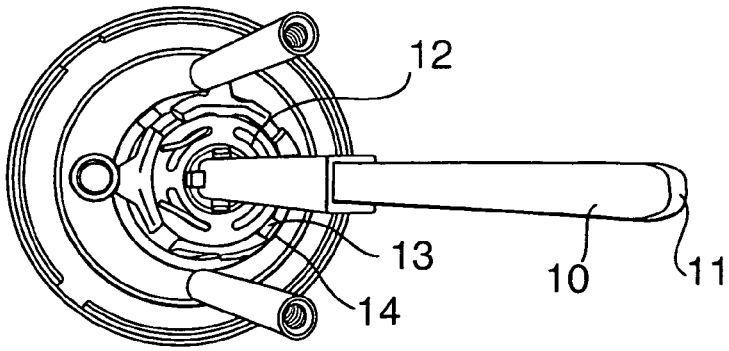
FIG. 3 is a perspective view of a the inside of the door knob mechanism of FIG. 2.
Figure 4:
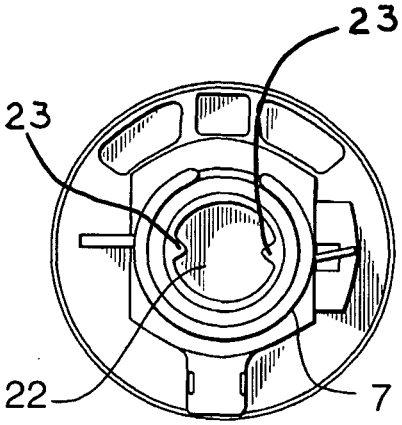
FIG. 4 is a rear end view of the cylinder with no aperture at the rear.
Figure 5:
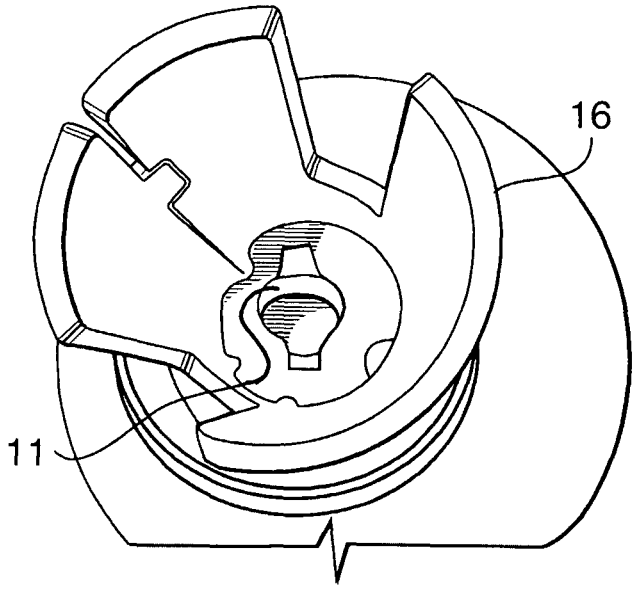
FIG. 5 is a perspective view of a the housing into which the cylinder is inserted.
Figure 7:
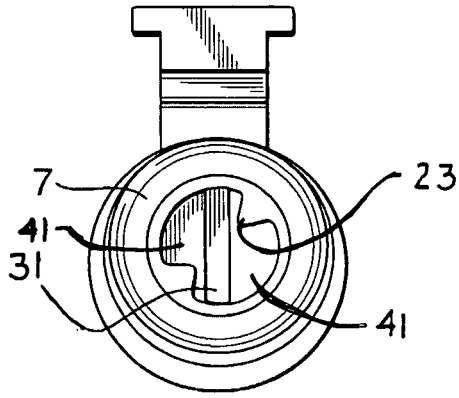
FIG. 7 is a rear end view of the cylinder with an aperture at the rear through which the forked tool is passed to turn the unlocking shaft.
Figure 11:
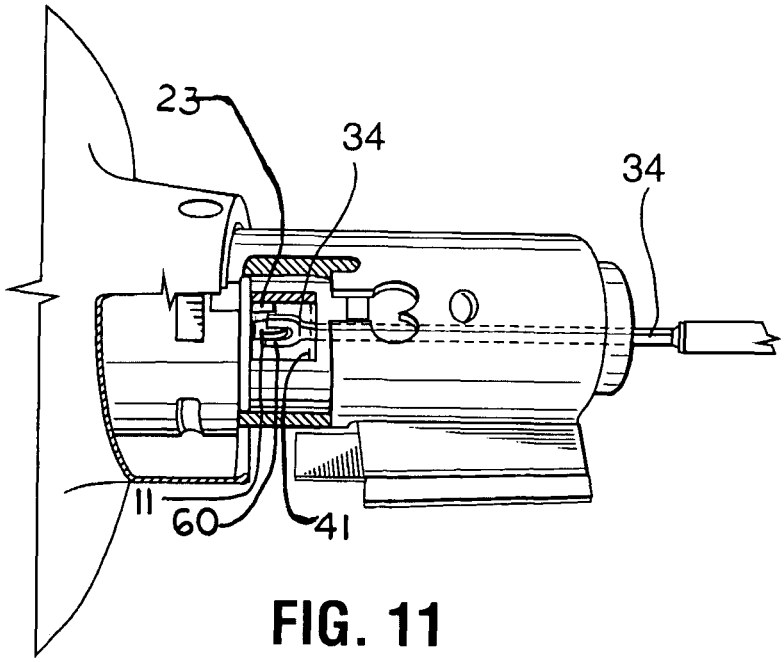
FIG. 11 is a cutaway side view of the cylinder with the fork straddling the end of the unlocking shaft.
Figure 12:
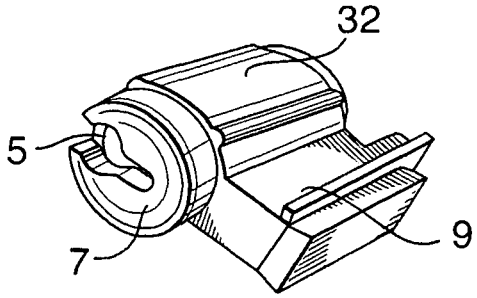
FIG. 12 is a front perspective view of a cylinder inside a barrel.

As best shown in FIGS. 1-5, most lockable door knobs 1 used today include keyed locks including a small cylinder 7 that turns inside a barrel 32 when the proper key is inserted into the key hole front end 5 of the cylinder 7. The opposite end of the cylinder 7 defines a rear wall 41 at the rear end of the cylinder having a rectangular aperture 31 therethrough. A modified Figure '8' shaped socket 22 is defined by a pair of opposing inner cylinder lugs 23 extending radially inward from the rear wall of cylinder 7 as shown in FIGS. 4, 7 and 11. The end 11 of shaft 10 is positioned within and engageable with the lugs 23 of the Figure '8' shaped socket 22 so that when the cylinder 7 is turned at least more than a quarter revolution, shaft 10 is turned also. Rectangular shaft 10, as shown in FIG. 3, then turns a cam inside the lock mechanism 12 to withdraw a tang from a notch thus allowing the knob to turn.

Socket 22 is Figure '8' shaped because, after a key is used to turn cylinder 7 one direction or the other, the key must always be returned to a vertical position in order to be removed. When the key is turned to the right 90° to lock the lock, the key must return to vertical without unlocking the lock, in order to be removed. Likewise, when the key is turned 90° to the left to unlock the lock, the key must again return to vertical without locking the lock, in order to be removed. So there must be some 'dwell time' wherein the cylinder is turning but the shaft 10 remains in a desired position. It should be noted that Figure '8' shaped socket 22 shown in FIG. 4 has a solid base, whereas FIG. 7 shows a FIG. 8 shaped socket with a rectangular shaped aperture 31 in the base.

Figure 6A:
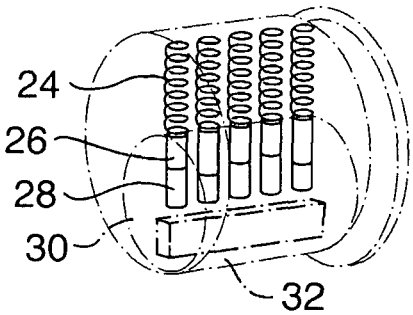
FIG. 6*a* is a cut away view of a cylinder and barrel showing springs and pin pairs.
Figure 6B:
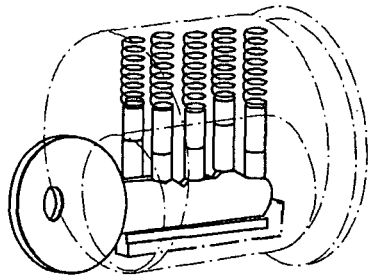
FIG. 6*b* is a perspective view of a cylinder and barrel showing springs, pin pairs, and an incorrect key.
Figure 6C:
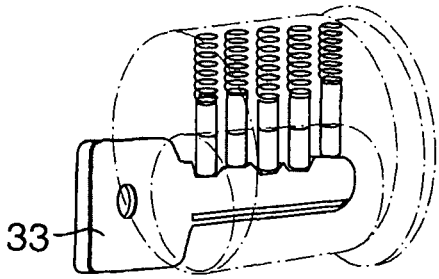
FIG. 6*c* is a perspective view of a cylinder and barrel showing springs, pin pairs aligned by the correct key.
Figure 6D:
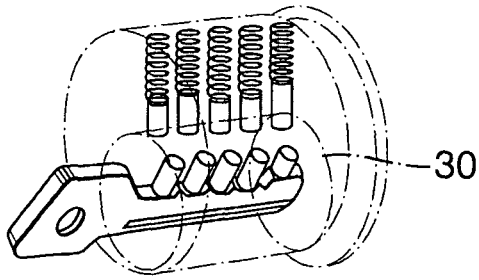
FIG. 6*d* is a perspective view of a cylinder and barrel showing springs, pin pairs aligned and being turned by the correct key.

A typical key lock cylinder is shown in FIGS. 6*a*-6*d*. Cylinder 30 is rotatably held within barrel 32. Five pairs of vertical pins of various lengths reside in cylindrical voids in both cylinder 30 and barrel 32 along with a spring at the top of the pin pairs. The springs 24 are pressing downward on the pin pairs. It can be noted that unless the pin pairs are all at the required positions, the cylinder 30 cannot be turned within the barrel 32 with a key. In FIG. 6*c*, the proper key 33 has raised the 5 pin pairs to their respective correct positions so that, as shown in FIG. 6*d*, the cylinder 30 can now be turned within barrel 32 by the key 33. When cylinder 30 is turned within barrel 32, the top pins of each pair remain stationary within barrel 32 while the bottom pins are carried within cylindrical voids in cylinder 30 as cylinder 30 is turned.

When key 33 is lost, in order to open the door without destroying part of the lock, the lock can be 'picked' using a small screw driver or leaf spring held in key way 5 to slightly bias the cylinder either in the clockwise or counterclockwise direction while using a pick (or longitudinal member with a tooth at the end shaped like one of the teeth of a key) to properly position the 5 pin pairs so that they are held by the biasing force at the unlock position, whereupon the biasing force will now turn the cylinder to lock or unlock the lock as desired. This lock picking process requires manual dexterity, experience, luck and perhaps a great deal of time to perform successfully.

Figure 8:
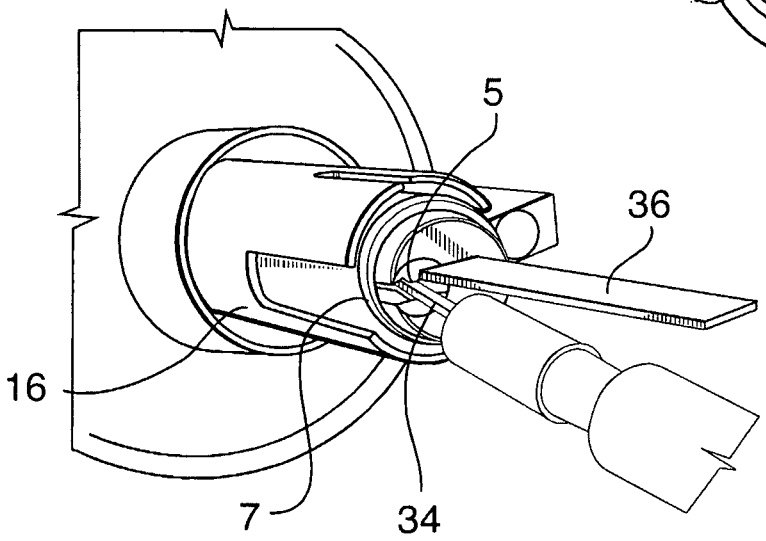
FIG. 8 is a perspective view of a key cylinder with the pin tool and the forked tool inserted into the key way.
Figure 9:
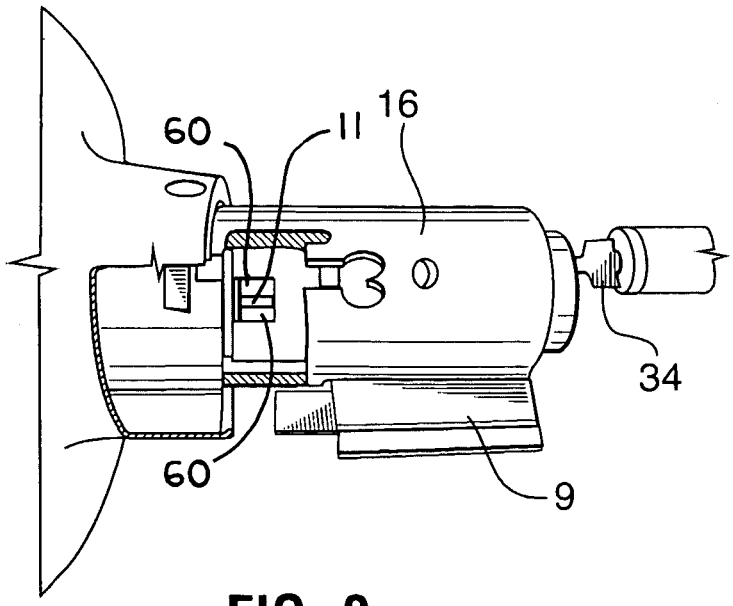
FIG. 9 is a side view showing the forked tool inserted into the cylinder.
Figure 14:
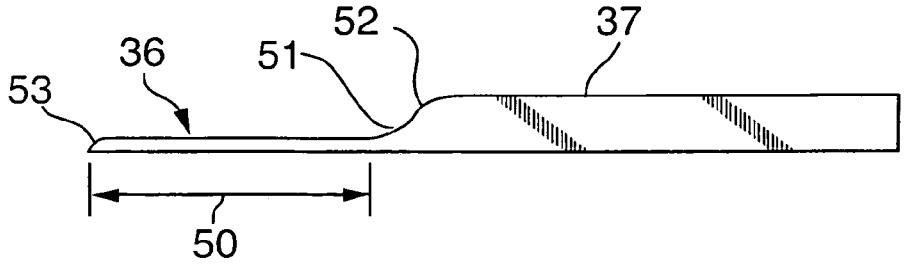
FIG. 14 is a perspective view of a pick and handle assembly.
Figure 10:
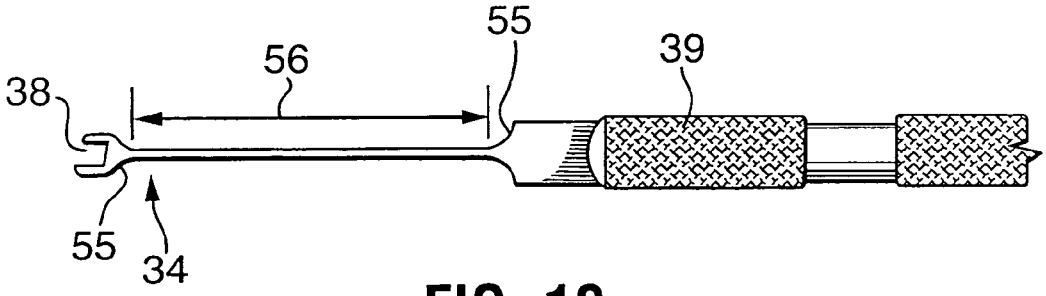
FIG. 10 is a front view of the pin tool and the forked tool.

However, many locks used today contain a cylinder 7 with the Figure '8' shaped socket 22 including a rectangular shaped aperture 31 extending from the key way side of cylinder 7, through and out of the opposite end of cylinder 7, as shown in FIG. 7. As best illustrated in FIGS. 8-10, a pin lifting tool 36, including a handle 37 with a longitudinal member 40 extending therefrom, can be inserted into key way 5 and raised to lift the 5 pin pairs up into barrel 32. Now, a forked tool 34 can be passed through cylinder 7, passing under pin lifting tool 36 and the 5 pin pairs, through rectangular aperture 31 and directly against end 11 of shaft 10. The forked tool includes a handle 39, with a forked longitudinal member 38 extending therefrom, with forked member 38 attached to the free end of the longitudinal member. With the forked end 38 of forked tool 34 straddling the end 11 of shaft 10, as shown in FIG. 11, pin tool 36 may be withdrawn from cylinder 7 as shown in FIG. 9, and tool 34 may be turned, thus turning shaft 10 to unlock the door knob lock.

The task of holding and aligning the 5 pin pairs, as is required when using a 'pick' and picking the lock, is rendered unnecessary because, with forked tool 38 turning shaft 10, it is unnecessary to turn cylinder 7 at all. Forked tool 34 actually bypasses cylinder 7 and the 5 pin pairs, and directly unlocks the lock.

One embodiment of the present invention includes a forked tool 34 wherein the fork is sized to easily pass though a key way 5 which is 0.0535 inches wide and 0.3375 inches high, while the pin lifting tool is in the key way holding up the pin pairs. If fork 38 is too wide or too thick to pass through key way 5 while pin lifting tool 36 is inserted through key way 5 to hold pins pairs 26 and 28 out of the way, forked tool 34 cannot be used. Therefore, the overall width 64 of fork 38 combined with the width 35 of pin lifting tool 36 cannot be greater that the height of key way 5. Length 56 of forked tool 34 must be longer than the length of cylinder 7, since tool 34 must extend through cylinder 7 whereupon fork 38 is placed astraddle of end 11 of shaft 10.

Figure 13:
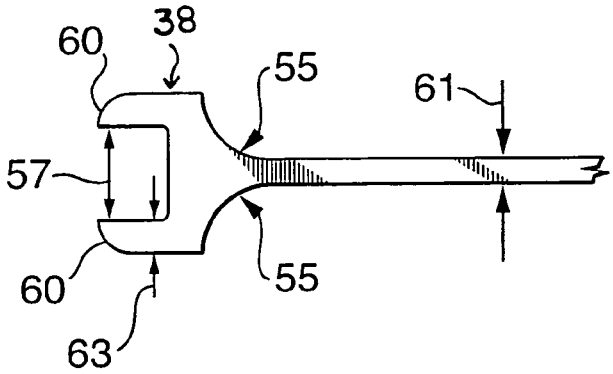
FIG. 13 is side view of the pick used to rotate the lock shaft.

An embodiment of the present invention shown in FIGS. 10 and 13, includes a forked tool 34 wherein shaft length 56 is at least 1.338 inches long, inner radii are approximately 0.0625 inches, outer fork prong radii 60 are approximately 0.039 inches, fork gap 57 is approximately 0.085 inches, width of the two individual fork tines 63 is approximately 0.040 inches, overall fork width 64 is approximately 0.165 inches, depth 59 of the fork throat is approximately 0.108 inches, and the thickness of forked tool is approximately 0.025 inches This embodiment also includes pin lifting tool 36 wherein length 50 is at least 1.188 inches, inner radius 51 and outer radii 52 and 53 are approximately 0.075 inches, and the thickness of pin lifting tool 36 is approximately 0.025 inches.

The tine widths 63, the fork gap width 57 and the width 35 of pin lifting tool may vary as long as the overall width 64 of the fork combined with the width 35 of the pin lifting tool is less than the height of key way 5 which is 0.3375 inches, as long as the fork is strong enough to turn the unlocking shaft 10 and the lifting tool is strong enough to lift the pin pairs. Further, the fork gap width 57 must be at least 0.087 inches so that the fork tines will easily straddle the unlocking shaft 10, which is 0.085 inches thick.

To use the tools, insert the narrow end of the tool 36 into the lock pushing upward to push the lock pins out of the way to make room for the tool 34 to be inserted into the lock channel or groove going all the way to the end or back wall of the channel opening. Then push upward with the tool 34 o find the rod in the lock and turn the tool 34 counter clockwise to unlock the lock. Before removing the tool 34, open the door and leave the picks or tools inserted into the groove of the door knob lock. With the door open turn the tool or knob grip to relock the lock for the lock must be in the lock position in order to remove the tool 34 from the lock.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. An improved door knob unlocking apparatus for a door knob lock having a cylinder rotatably disposed within a barrel of a door knob, the cylinder including a pair of opposing cylinder lugs extending radially inward from a rear wall of the cylinder wherein the rear wall of the cylinder includes a slot therethrough whereby a distal end of a longitudinal shaft extending from a cam mechanism of the lock cooperatively engages the cylinder lugs for locking and unlocking an opposing connecting second doorknob and allowing the first doorknob and second doorknob to turn, the cylinder and the barrel having a plurality of parallel transverse coaxial pairs of cylindrical voids formed therein and a spring urging a plurality of pins of various lengths cooperatively engaging the barrel through corresponding coaxial cylindrical voids, one pin above the other, toward a center of the cylinder, the cylinder having a key way formed in a first end thereof, the pin pairs preventing the turning of the cylinder within the barrel unless the pins are urged against the springs at a selected position wherein each of a top one of the pairs is totally contained within the cylindrical void formed within the barrel and each of a lower one of the pin pairs is totally contained within the cylindrical voids formed within the cylinder, wherein a selected key inserted into the key way aligns the pins for turning the cylinder within the barrel, the cylinder including an aperture formed within a second end thereof, wherein the apparatus improvement comprises:

a pin lifting tool comprising a first longitudinal member extending from the end thereof, said first longitudinal member having a width and height less than said key way and a length sufficient to contact and lift all of said pin pairs up into said cylindrical voids; and a forked tool comprising a second longitudinal member including a fork formed on a distal end thereof, said fork having a width and height less than said key way, said second longitudinal member having a length sufficient to extend pass said pins, and thorough said slot in said rear wall of said cylinder to cooperatively engage a distal end of said rectangular shaft, said forked tool passing through said key way beneath said first longitudinal member of said pin lifting tool holding said pin pairs within said cylindrical voids for locking or unlocking said door knob lock.

2. The door knob unlocking tool kit defined in claim 1 wherein a gap of said fork is at least 0.087 inches wide.

3. The door knob unlocking tool kit defined in claim 1 wherein the overall width of said fork combined with the width of said pin lifting tool is less than 0.3375 inches.

4. The door knob unlocking tool kit defined in claim 1 wherein said first longitudinal member is at least 1.188 inches long.

5. The door knob unlocking tool kit defined in claim 1 wherein said second longitudinal member is between at least 1.338 inches long.

6. The door knob unlocking apparatus of claim 1, wherein said lock is unlocked without rotation of said cylinder.

7. The door knob unlocking apparatus of claim 1, wherein said fork includes an inner radii of approximately 0.0625 inches, an outer radii of approximately 0.039 inches a fork gap of approximately 0.085 inches.

8. The door knob unlocking apparatus of claim 1, wherein said fork includes a pair of fork tines having a inner width of approximately 0.040 inches.

9. The door knob unlocking apparatus of claim 1, wherein said fork thickness comprises approximately 0.025 inches.

10. The door knob unlocking apparatus of claim 1, wherein said fork includes an overall fork width of approximately 0.165 inches, a depth of the fork throat of approximately 0.108 inches.

11. The door knob unlocking apparatus of claim 1, wherein said pin lifting tool comprises a length of at least 1.188 inches, and a thickness of approximately 0.025 inches.

12. The door knob unlocking apparatus of claim 1, wherein said pin lifting tool includes means for holding.

13. The door knob unlocking apparatus of claim 1, wherein said pin lifting tool means for holding comprises an enlarged blade portion on the proximate end of said first longitudinal member.

14. The door knob unlocking apparatus of claim 1, wherein said pin lifting tool includes means for holding comprises an enlarged blade portion on the proximate end of said first longitudinal member which cooperatively engages a slot formed in a distal end of a handle.

15. The door knob unlocking apparatus of claim 1, wherein said forked tool includes means for holding.

16. The door knob unlocking apparatus of claim 1, wherein said forked tool means for holding comprises an enlarged blade portion on the proximate end of said first longitudinal member.

17. The door knob unlocking apparatus of claim 1, wherein said forked tool means for holding comprises an enlarged blade portion on a proximate end of said first longitudinal member which cooperatively engages a slot formed in a distal end of a handle.

18. An improved door knob unlocking apparatus for a duel doorknob locking assembly having a first door knob lock including a cylinder rotatably disposed within a barrel, said cylinder including a pair of opposing cylinder lugs extending radially inward from a rear wall of said cylinder wherein said rear wall of said cylinder includes a slot therethrough whereby a distal end of a longitudinal shaft extending from a cam mechanism of said lock cooperatively engages said cylinder lugs for locking and unlocking an opposing connecting second doorknob and allowing said first doorknob and second doorknob to turn, said cylinder and said barrel having a plurality of parallel transverse coaxial pairs of cylindrical voids formed therein and a spring urging a plurality of pins of various lengths cooperatively engaging said barrel through corresponding coaxial cylindrical voids, one pin above said other, toward said cylinder center, said cylinder having a key way formed in a first end thereof, said pin pairs preventing said turning of said cylinder within said barrel unless said pins are urged against said springs at a selected position wherein each of a top one of said pairs is totally contained within said cylindrical void formed within said barrel and each of a lower one of said pin pairs is totally contained within said cylindrical voids formed within said cylinder, wherein a selected key inserted into said key way aligns said pins for turning said cylinder within said barrel, said cylinder including an aperture formed within a second end thereof, wherein said duel doorknob locking assembly unlocking apparatus comprises:

a pin lifting tool comprising a first longitudinal member extending from said end thereof, said first longitudinal member having a width and height less than said key way and a length sufficient to contact and lift all of said pin pairs up into said cylindrical voids; and a forked tool comprising a second longitudinal member including a fork formed on a distal end thereof, said fork having a width and height less than said key way, said second longitudinal member having a length sufficient to extend pass said pins, and thorough said slot in said rear wall of said cylinder to cooperatively engage a distal end of said rectangular shaft, said forked tool passing through said key way beneath said first longitudinal member of said pin lifting tool holding said pin pairs within said cylindrical voids for locking or unlocking said door knob lock.

19. A method of using an improved door knob unlocking apparatus for a duel doorknob locking assembly having a door knob lock including a cylinder rotatably disposed within a barrel, said cylinder including a pair of opposing cylinder lugs extending radially inward from a rear wall of said cylinder wherein said rear wall of said cylinder includes a slot therethrough whereby a distal end of a longitudinal shaft extending from a cam mechanism of said lock cooperatively engages said cylinder lugs for locking and unlocking an opposing connecting second doorknob and allowing said first doorknob and second doorknob to turn, said cylinder and said barrel having a plurality of parallel transverse coaxial pairs of cylindrical voids formed therein and a spring urging a plurality of pins of various lengths cooperatively engaging said barrel through corresponding coaxial cylindrical voids, one pin above said other, toward said cylinder center, said cylinder having a key way formed in a first end thereof, said pin pairs preventing said turning of said cylinder within said barrel unless said pins are urged against said springs at a selected position wherein each of a top one of said pairs is totally contained within said cylindrical void formed within said barrel and each of a lower one of said pin pairs is totally contained within said cylindrical voids formed within said cylinder, wherein a selected key inserted into said key way aligns said pins for turning said cylinder within said barrel, said cylinder including an aperture formed within a second end thereof, wherein said duel doorknob locking assembly unlocking apparatus comprising the steps of inserting a pin lifting tool first longitudinal member into a key way lifting said a plurality of spring loaded pin pairs up into said cylindrical voids and holding said pins in a nonengaging uplifted position; and inserting a fork extending from a distal end of second longitudinal member through said key way beneath said pin lifting tool and past said pins, through a slot formed in said rear wall of said cylinder to cooperatively engage a distal end of a rectangular shaft extending from a cam mechanism of said opposing connecting second doorknob; and rotating said forked tool unlocking or locking said lock allowing said first doorknob and second doorknob to rotate.

* * * * *